US005487234A

United States Patent [19]

Dragon

[11] Patent Number: 5,487,234

[45] Date of Patent: Jan. 30, 1996

[54] FIREARM LOCKING DEVICE WITH MOTION SENSOR AN D ALARM

[76] Inventor: Paul K. Dragon, 1366-B Jeffords St., Clearwater, Fla. 34616

[21] Appl. No.: 158,923

[22] Filed: Nov. 29, 1993

[51] Int. Cl.[6] ..... F41A 17/54

[52] U.S. Cl. ..... 42/70.07

[58] Field of Search ..... 42/70.07, 70.06, 42/70.09, 70.11, 1.01

[56] References Cited

U.S. PATENT DOCUMENTS

| | | | |
|---|---|---|---|
| 2,664,658 | 1/1954 | Bjorklund | 42/70.07 |
| 3,624,945 | 12/1971 | Foote | 42/70.07 |
| 4,499,681 | 2/1985 | Bako et al. | 42/70.07 |
| 4,541,191 | 9/1985 | Morris et al. | 42/1.01 |
| 5,283,971 | 2/1994 | Fuller et al. | 42/70.07 |
| 5,309,661 | 5/1994 | Fuller et al. | 42/70.07 |

*Primary Examiner*—Charles T. Jordan
*Attorney, Agent, or Firm*—William L. London, III; Michael G. Johnston; Moore & Van Allen

[57] ABSTRACT

A firearm locking device and alarm that incorporates a universal, self-conforming trigger lock which prevents access to the trigger and unauthorized operation of the firearm and deters unauthorized movement. The device comprises a clamp section and an alarm section which houses a motion sensor for detection of movement of the firearm and for generation of an alarm activating signal. An internal microcomputer is provided to receive the alarm activating signal from the motion sensor. The microcomputer will permit sufficient time for the locking device and alarm to be unlocked or disabled. If the unit is not unlocked or disabled following movement of the firearm an audible alarm is activated. A key-actuated switch is provided to enable or disable the firearm locking device and alarm.

23 Claims, 5 Drawing Sheets

FIREARM LOCKING DEVICE WITH MOTION SENSOR AND ALARM

BACKGROUND

This invention relates to a locking device for firearms, and more particularly to a firearm locking device with a motion sensor and alarm for detecting and announcing the unauthorized movement of the firearm thereby preventing its unauthorized use.

At present, there are an estimated 210,000,000 firearms in the United States. Over 70 million Americans own firearms and more Americans are purchasing firearms than ever before. For the safety and protection of themselves and their families, many new consumers who would not normally purchase a firearm for purely recreational or hunting purposes are entering the firearm market. As a result, firearms are becoming more prevalent in many households.

While many people want the protection provided by having a readily available personal firearm or are interested in firearms for recreation or hunting, they are also justifiably concerned about the danger inherent in a family member, friend or stranger misusing or tampering with the firearm. Consequently, feelings of security are often offset by the feelings associated with having a potentially dangerous firearm in the home. This is particularly true when there are children present in the home. All too often there are reports of accidental and intentional injuries and death resulting from the unauthorized and unsupervised use of firearms involving children. Thus, there is a need for safely storing a firearm to prevent this type of tragedy. Furthermore, firearms are a prized target for intruders into the home during a burglary. Accordingly, there is a need for deterring thefts of firearms from the home.

Adjustable trigger locks for preventing the unauthorized operation of firearms are well known in the art. Usually they involve a key-operated locking mechanism. Alternatively, the degree of manual dexterity required to operate the lock is so great as to effectively render the device child-proof. However, these prior art trigger locking devices are strictly mechanical and do not provide any form of alarm to indicate that the firearm is being tampered with or to deter children and other persons from moving the firearm, or from using a standard electric drill or hammer to successfully remove the lock. Moreover, some trigger lock mechanisms do not enclose the trigger, which may invite handling and subsequent accidental discharge of the weapon.

Additionally, various anti-theft alarm devices comprising a motion sensing component in conjunction with an alarm for the protection of portable items are also known. A conventional motion sensor and alarm generally includes components such as an AC or DC electrical power source to energize the device; a switch mechanism for turning the unit on and off; a mechanical, electrical, thermal, or optical sensor for detecting the alarming situation; and a visual or an auditory alarm for alerting the user. While numerous such devices have proven effective in their limited applications, there are no such alarm devices for the specific security needs of firearms. Furthermore, many of theme devices require the protected item be placed in a predetermined position, have a motion sensing algorithm which is inapplicable to firearms, or generally will not safely secure a firearm. Finally, the firearm alarm devices which are currently available do not include a motion detection device thereby permitting the firearm to be removed and the alarm device to be destroyed at leisure or to be ignored.

For the foregoing reasons, there is a substantial need for a motion sensitive anti-theft, anti-operation locking device and alarm for use with firearms which is capable of preventing the operation or deterring the movement of the firearm by a child or other unauthorized persons. The device must be universally applicable to all types of conventional firearms, easy to operate, and allow quick accessibility to the firearm. The device must also fully enclose the trigger and trigger guard of the firearm to prevent accidental discharge and must not be capable of being ignored or destroyed by an unauthorized person.

SUMMARY

The present invention is directed to a novel firearm locking device and alarm that satisfies theme needs for the benefit of firearm owners, and for the safety of their families, particularly children. The firearm locking device and alarm of the present invention is a durable, lightweight and user-friendly computer-based mechanism that is installed across the trigger guard of conventional firearms. The advanced electronics equipment comprising the present invention contains features not presently available in firearm safety and security products. This device, when attached to a firearm, not only prevents operation of the firearm, but also alerts the owner that the gun has been or is being moved. Yet, quick, silent access to the firearm is available for purposes of self-protection.

The present invention comprises a firearm locking device with motion sensor and alarm which is detachably mounted on the trigger guard of a firearm to prevent the operation and deter movement of the firearm, comprising a pair of laterally separated sections, with one of the sections being termed the "alarm" section and the other the "clamp" section. The alarm section and clamp section are lockably connected against opposite faces of the trigger guard so as to engage therebetween, substantially enclosing and preventing access to, the trigger and trigger guard of the firearm.

The alarm section houses an internal DC power source, a motion sensing means for sensing movement of the firearm, a microcomputer, a key-actuated enabling switch for activating the microcomputer and locking the alarm section and the clamp section together, and an auditory alarm.

The opposed surfaces of the alarm section and the clamp section are provided with resilient pads with the face of each pad having a plurality of protuberances. The resilient pads allow the present invention to be conformed to and grip the trigger guard when operably connected to any conventional firearm. The pads further prevent the device from shifting or working loose on the trigger guard. The trigger, therefore, cannot be accessed or accidentally moved when the locking device and alarm are in place.

The means for lockably connecting the alarm section to the clamp section comprises a lock pin connected to the clamp section having serrations extending along the longitudinal axis of the surface of one side of the lock pin, a lock pin hole guide in the alarm section for receiving the lock pin, a catch located within the alarm section having serrations which are complimentary in shape to the serrations on the lock pin for engaging the lock pin, a resilient means for biasing the catch into engagement with the lock pin, and a key-actuated switch for releasably positioning the serrations of the catch in or out of engagement with the serrations on the lock pin whereby the alarm section and the clamp section may be adjustably connected against the opposite faces of the trigger guard of the firearm in spaced relation. As noted above, the key-actuated switch also serves as an enabling switch for activating the microcomputer.

When the device is first installed on the firearm, the owner is given sufficient time to place the firearm in its stored position. The device will then emit a distinctive, audible sound to inform the owner that it is enabled. When an unauthorized person such as child or an intruder moves the firearm, the device will generate an audible alarm signal. The objective is to frighten the child or deter the thief and at the same time alert the owner. An intruder may also be frightened into leaving the area. However, there is a delay following the initial movement of the firearm before the alarm signal is generated thereby allowing the owner time to silently disable or unlock the device with a key, If the device is not disabled or unlocked within this time delay from the initial movement of the firearm, an audible alarm will sound for a fixed period of time. The device will then automatically turn off the alarm and reset itself to await a further movement of the firearm. Should the device be disabled or unlocked with the key while the alarm is sounding, the alarm will automatically be turned off.

BRIEF DESCRIPTION OF THE DRAWINGS

These and other features, aspects, and advantages of the present invention will become better understood with regard to the following description, appended claims, and accompanying drawings where:

DESCRIPTION

The firearm locking device and alarm of the present invention is a detachable, portable lock with motion sensor and alarm for substantially enclosing the trigger guard portion and trigger of any conventional firearm thereby preventing its unauthorized operation and deterring its movement. The locking device and alarm is adjustable and self-conforming so as to fit all types of trigger guards of conventional firearms, regardless of the size of the trigger guard or the location of the trigger. The present invention is also designed to be non-shiftable in relation to the trigger guard thereby preventing the trigger from being accidentally exposed.

Figure 1:
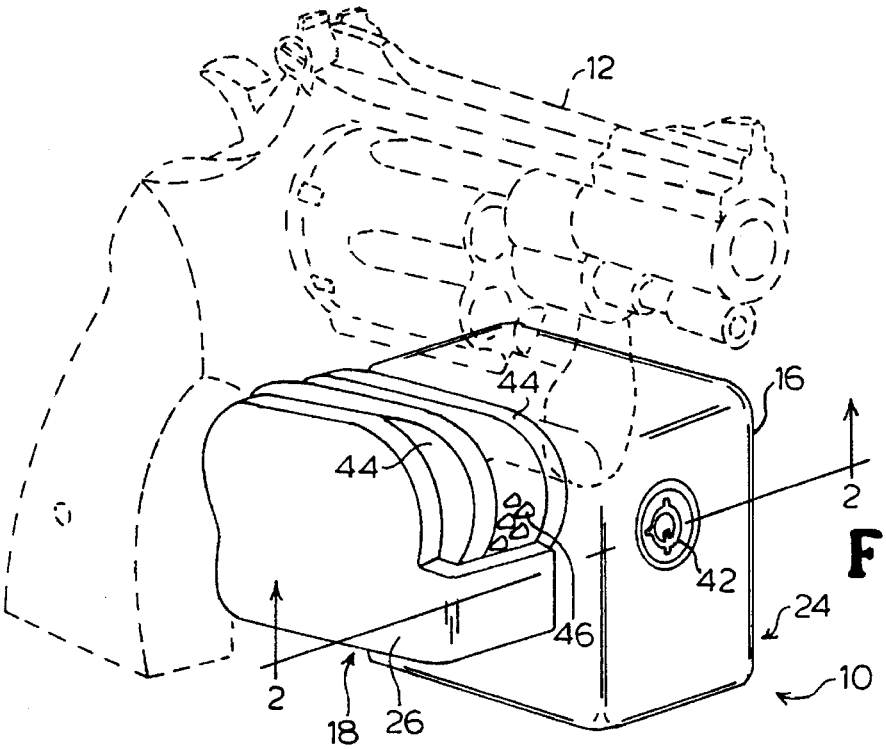
FIG. 1 is a perspective view of an embodiment of the firearm locking device and alarm operatively connected to a firearm.
Figure 2:
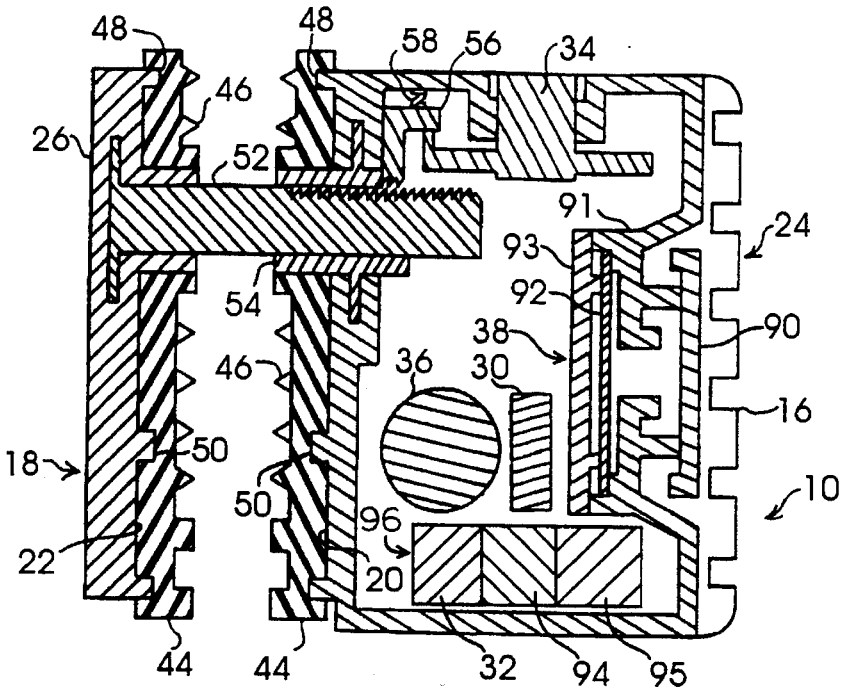
FIG. 2 is a cross-sectional view taken along line 2—2 of FIG. 1 of the mechanical components of an embodiment of the present invention substantially enclosing the trigger and trigger guard of a firearm, the firearm trigger and trigger guard being omitted.
Figure 3:
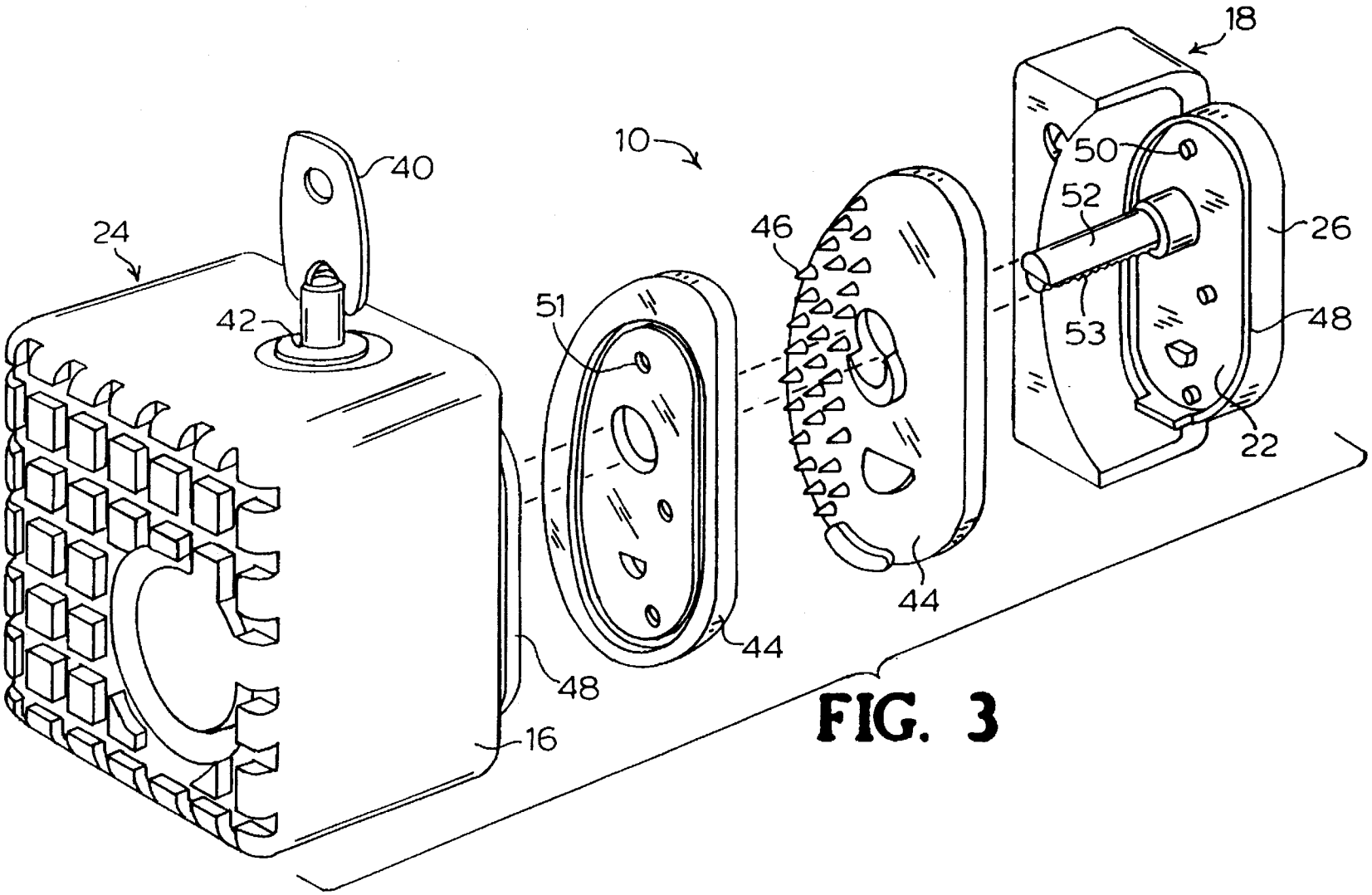
FIG. 3 is a detached exploded, perspective view of the components of an embodiment of the firearm locking device and alarm.

As shown in FIG. 1, an embodiment of the present invention designated generally by the numeral 10 is mounted on a firearm 12 substantially enclosing the trigger and trigger guard. FIG. 2 is a cross-sectional view taken along line 2—2 of FIG. 1 of the mechanical components of an embodiment of the present invention substantially enclosing the trigger and trigger guard of a firearm, the firearm trigger and trigger guard being omitted. FIG. 3 is a detached exploded, perspective view of the components of an embodiment of the firearm locking device and alarm 10. An embodiment of the firearm locking device and alarm 10 is shown in FIG. 1 in operative use in connection with a pistol 12. It will be understood, however, that the present invention is operable with all conventional firearms, including a rifle and a shotgun.

The firearm locking device and alarm 10 comprises a pair of laterally separated sections, with one of the sections being termed the "alarm" section 16 and the other the "clamp" section 18. The clamp section 18 and alarm section 16 are lockably connected across the trigger guard of a conventional firearm 12 so as to prevent access thereto when they are locked together in their operative position. Though the alarm section 16 and clamp section 18 may be of any shape or size, they are preferably configured to fit over the opposite sides of a trigger guard of any conventional type of firearm 12. The opposing face 20 of the alarm section 16 and the opposing face 22 of the clamp section 18 are preferably of similar shape and size. The body 24 of the alarm section 16 and the body 26 of the clamp section 18 are of unitary construction and may be constructed of any tough, rigid material such as polycarbonate, lexan, PPS, and the like. The preferred material of construction is polycarbonate.

Figure 4:
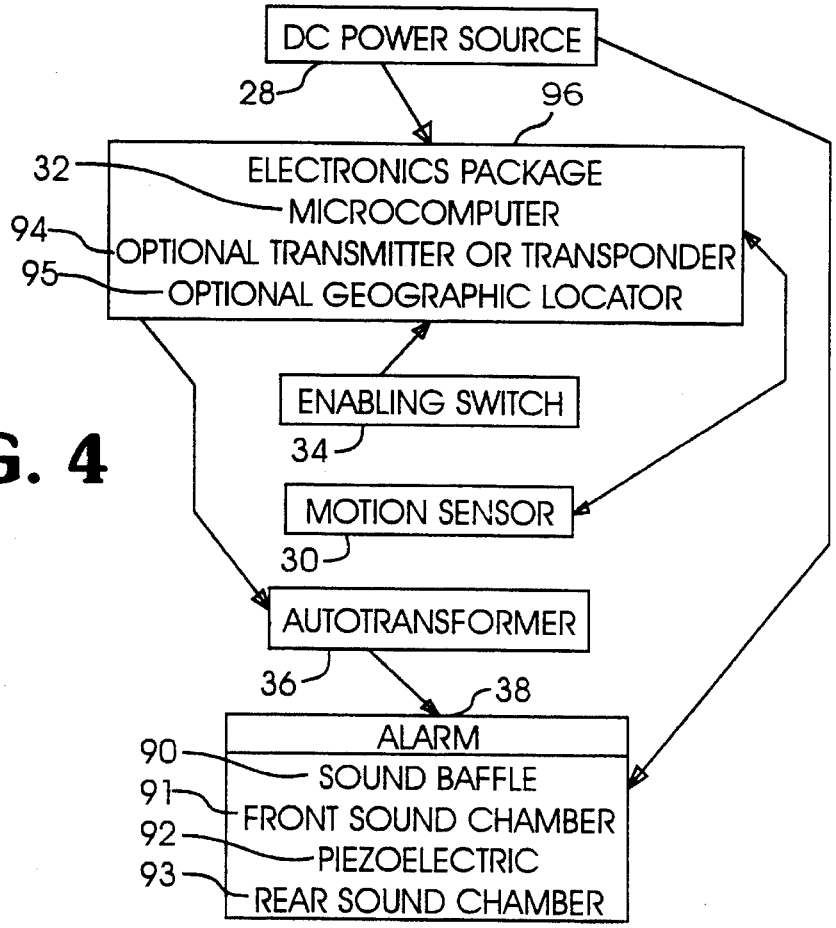
FIG. 4 is a block diagram of the electronic components and circuitry of an embodiment of the present invention.

As shown in FIG. 2 and FIG. 4, located within the alarm section 16 is the electronic circuitry for the device 10 comprising a DC power source 28, motion sensor 30, an electronics package 96, including a microcomputer 32, and optional transmitter or transponder 94, or satellite location 95, enabling switch 34, autotransformer 36, and alarm 38. The DC power source 28 must be capable of energizing the alarm 38. A battery having a voltage range of from about three to about nine volts is adequate for this purpose. Furthermore, only in the unlocked position of the device 10 will the DC power source 28 be accessible for removal and replacement.

The motion sensor 30 located within the alarm section 16 detects any vibration, tilt or change in position of the firearm 12 when the locking device and alarm 10 is operatively connected thereto. The motion sensor 30 may be any conventional type of motion sensor such as a magnetic reed switch, a mercury switch, a balanced ball switch, a microswitch, a mass loaded single or multi-point contact spring and the like. The preferred motion sensor 30 is a heart pacemaker motion sensor such as the type manufactured and available as a component part through Signal Systems, Inc.

The microcomputer 32 provided with the present invention contains an oscillator, low battery detection, a central processing unit, instruction read only memory, data read write memory and external input/output contact pins. A microcomputer having these features and functional for use in the present invention is PIC part#16C54 manufactured by Microchip of Phoenix, Ariz.

The enabling switch 34 is a mechanical, key-actuated switch which has both a mechanical locking function and a microprocessor 32 enabling function when the alarm section 16 and clamp section 18 are lockably connected. A key 40 is inserted through a keyhole 42 in the body 24 of the alarm section 16 to operate the enabling switch 34. The key 40, when inserted into the exposed end of the keyhole 42 and turned to the appropriate position, actuates the enabling switch 34 and enables the microcomputer 32 to start its programmed operation as described below in connection with FIG. 5, and, as will be understood below, mechanically locks the alarm section 16 to the clamp section 18.

Figure 2A:
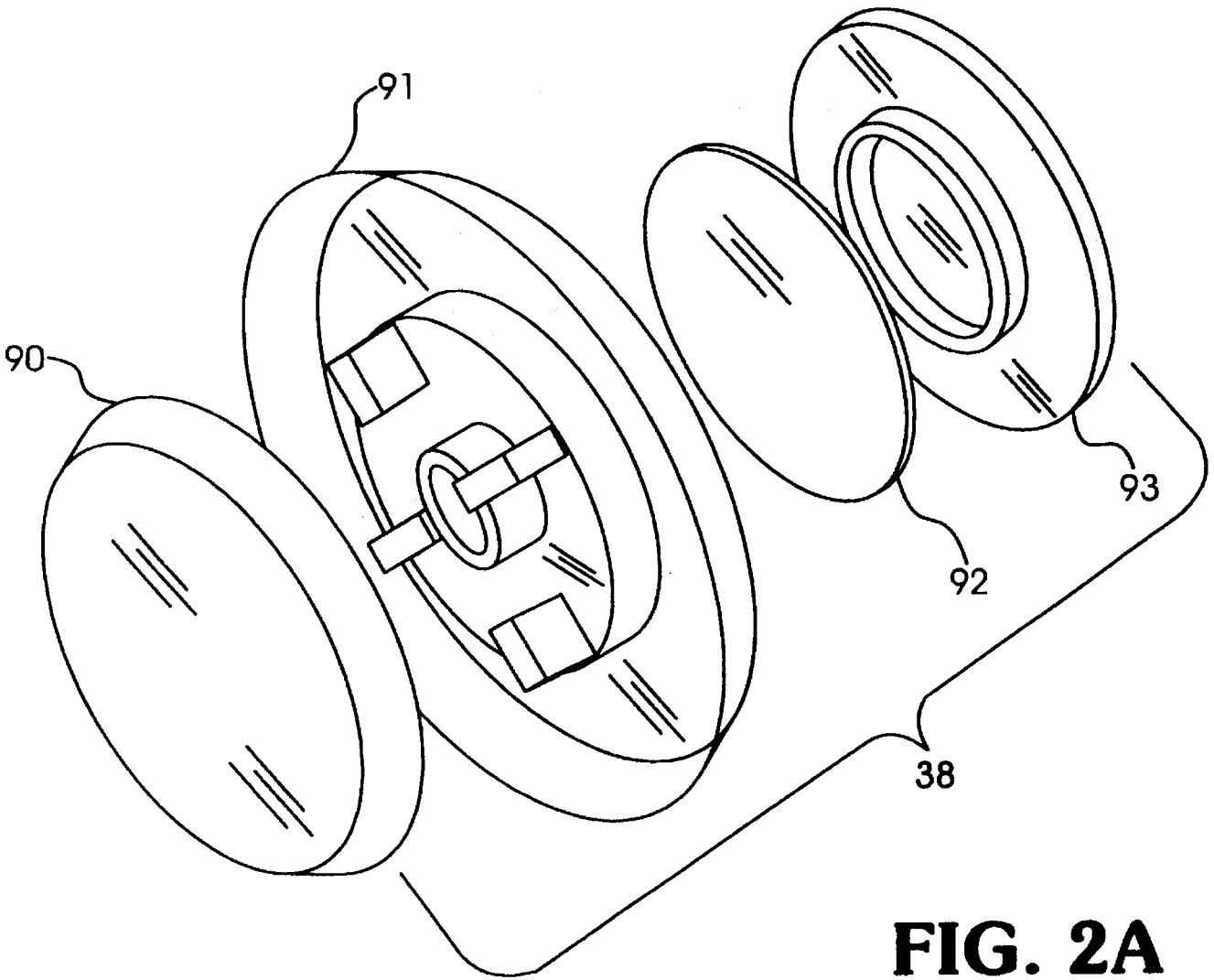
FIG. 2A is detached exploded perspective view of the components of an embodiment of tile alarm.
Figure 2B:
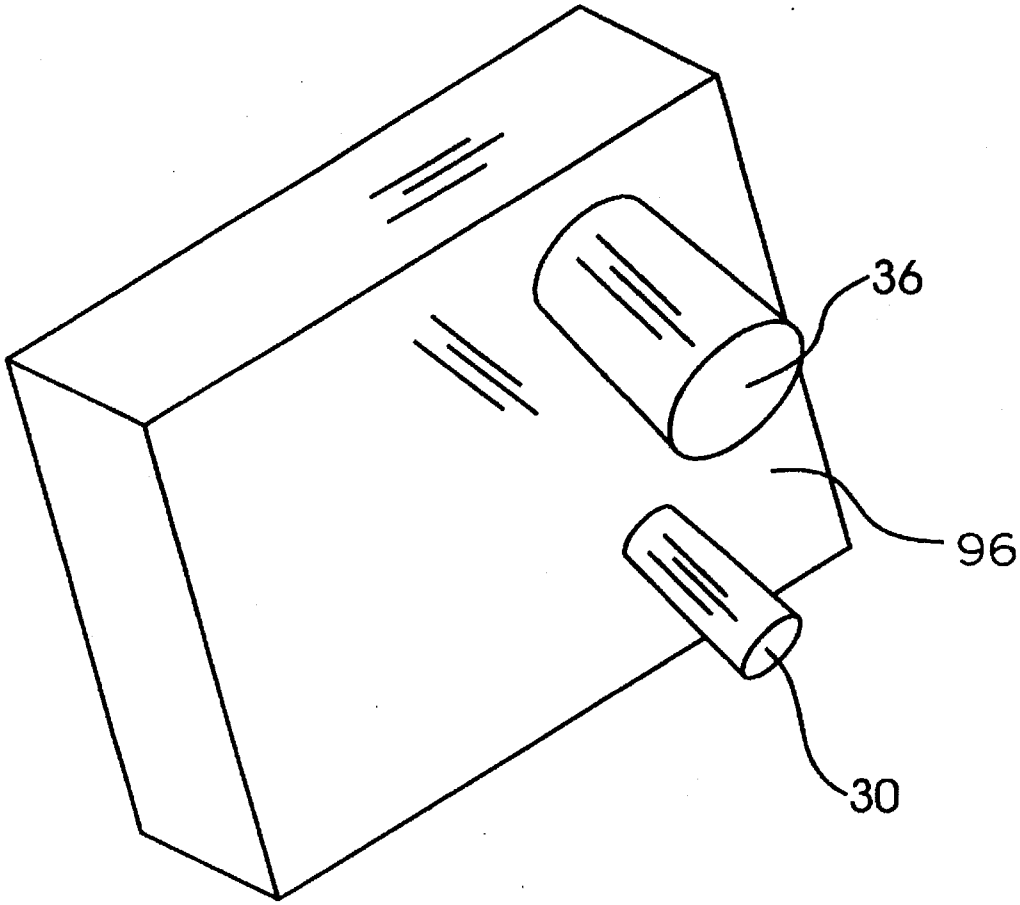
FIG. 2B is a perspective view showing the relationship between the electronics package, the autotransformer, and tile motion sensor.

The alarm 38 used in the present invention may be similar to components used in beepers, computers, timers and other devices where a high-pitched sound is used to gain the attention of the user. It may be a piezoelectric, a vibrating reed, or other electronic device. The alarm 38 used in the firearm locking device and alarm 10 is preferably an audible alarm for providing an audible alarm signal such as a siren. More preferably, the alarm 38 is a piezoelectric device such as those available from Murata, Inc., of Japan. An appropriately sized autotransformer 36 is also provided within the alarm section 16 to drive the alarm 38 to at least 100 decibels. An exploded view of a typical piezoelectric alarm is shown in FIG. 2*a*. The piezoelectric driver 92 rests on the rear sound chamber cover 93 and lies behind the main housing sound chamber 91. The cap or cover 90 protects this unit from contact with the elements and serves as part of the exterior housing.

Resilient pads 44 are provided on the opposed face 20 of the alarm section 16 and the opposed face 22 of the clamp section 18 so as to allow the device 10 to conform to the shape of the trigger and trigger guard. Thus, the present invention is self-conforming and adjustable to the breadth of any conventional trigger guard. The resilient pads 44 have cones 46 molded into them to help prevent the device 10 from sliding on the trigger guard 14, thereby preventing exposure of the trigger of the firearm 12, or moving enough for the lock pin 52 to actuate the trigger. The resilient pads 44 may be made of any resilient material such as rubber, soft plastic, RTV, silicone rubber and the like. The pads 44 also prevent marring of the trigger or trigger guard 14. Furthermore, as shown in FIG. 2 and FIG. 3, there is a raised lip 48 around the periphery of the opposed face 22 of the clamp section 18 and the opposed face 20 of the alarm section 16 which retains the pads 44 in position on their respective sections. There is also a plurality of raised nipples 50 on the opposed face 22 of the clamp section 18 and the opposed face 20 of the alarm section 16 which are received in complementary recesses 51 in the resilient pads 44 and which further inhibit movement of the pads 44 and sliding of the locking device and alarm 10 on the trigger guard.

As shown in FIG. 2, the means for lockably connecting the alarm section 16 and clamp section 18 across the trigger guard of a firearm 12 comprises a lock pin 52 connected to the clamp section 18 and extending transversely of the plane of the clamp section 18, a lock pin hole guide 54 in the alarm section 16 for receiving the lock pin 52, a catch 56 located within the alarm section 16 for holding the lock pin 52 within the lock pin hole guide 54, and means for releasably positioning the catch 56 in or out of engagement with the lock pin 52. The lock pin may be of any non-rotational shape but is preferably "D"-shaped. The lock pin 52, lock pin hole guide 54 and catch 56 are of metal construction or other rigid, high-strength material, preferably steel or aircraft aluminum. Alignment and structural strength are achieved by the lock pin hole guide 54. The lock pin 52 has serrations 53 on one side that are captured by complementary serrations on the catch 56 located within the alarm section 16. The catch 56 is biased into engagement with the lock pin 52 by a resilient means or spring 58 within the alarm section 16 to thereby hold the alarm section 16 and clamp section 18 in adjusted position relative to the opposite sides of the trigger guard. The key-actuated enabling switch 34 serves as the means for releasably positioning the catch 56 in or out of engagement with the lock pin 52. A turning movement of the key 40 will cause the catch 56 to be moved away from the lock pin 52 compressing the spring 58 and disengaging the respective serrations. The clamp section 18 and alarm section 16 may then be moved axially to accomplish removal of the locking device and alarm 10 from the firearm 12.

The key-actuated enabling switch 34 may be a three-position switch, which in a first position the device 10 is enabled and locked; in a second position the device is locked but disabled allowing movement while preventing operation of the firearm 12; and in a third position the device 10 is unlocked and disabled.

To apply the locking device and alarm 10 to a firearm 12, the alarm section 16 may be manually positioned against one face of the trigger guard with its resilient pad 44 in contact with the trigger guard. The clamp section 18 is then manually positioned against the opposite face of the trigger guard with its resilient pad 44 in contact with the trigger guard. The lock pin 52 connected to the clamp section 18 is passed transversely through the opening in the trigger guard and is received in the lock pin hole guide 54 in the alarm section 16 thus substantially enclosing the trigger guard within this "sandwich" and preventing access to the trigger. The alarm section 16 and clamp section 18 are manually squeezed together as tightly as possible against the opposite faces of the trigger guard. In applying the device 10 to the trigger guard of a firearm 12, the device 10 may be adjustably held and locked together in the desired degree of transverse separation. During this operation, the key-actuated enabling switch 34 is in a position so that the catch 56 is positioned away from the lock pin 52. When the alarm section 16 and clamp section 18 are in position against the trigger guard, the key 40 is turned thereby allowing the spring 58 to bias the catch 56 against the lock pin 52 thus engaging their respective serrations and locking the device 10 in place. In the locked position, the resilient pads 44 prevent the device 10 from shifting and exposing the trigger or the lock pin 52 from engaging and actuating the trigger. The device 10 cannot be removed without unlocking the device 10 with the key 40. Thus, it is impossible for an unauthorized person to accidentally or intentionally actuate the trigger.

FIG. 4 shows a block diagram of the electronic circuitry of the device 10 as shown in FIG. 1, FIG. 2, and FIG. 3. As noted above, the circuitry comprises an internal DC power source 28, a microcomputer 32, an enabling switch 34, a motion sensor 30, an autotransformer 36 and an alarm 38. As discussed above, the DC power source 28 may be a battery which is operatively connected to the microcomputer 32. The microcomputer 32 is connected between the DC power source 28 and the motion sensor 30. The enabling switch 34 is connected to the microcomputer 32 for activating the microcomputer 32 when the alarm section 16 and the clamp section 18 are locked together. An autotransformer 36 is connected to the microcomputer 32 for amplifying the alarm generating signal of the microcomputer 32. The alarm 38 is connected to the DC power source 28 and the autotransformer 36 for activation in response to an alarm activation signal from the microcomputer 32 to provide an alert signal.

Figure 5:
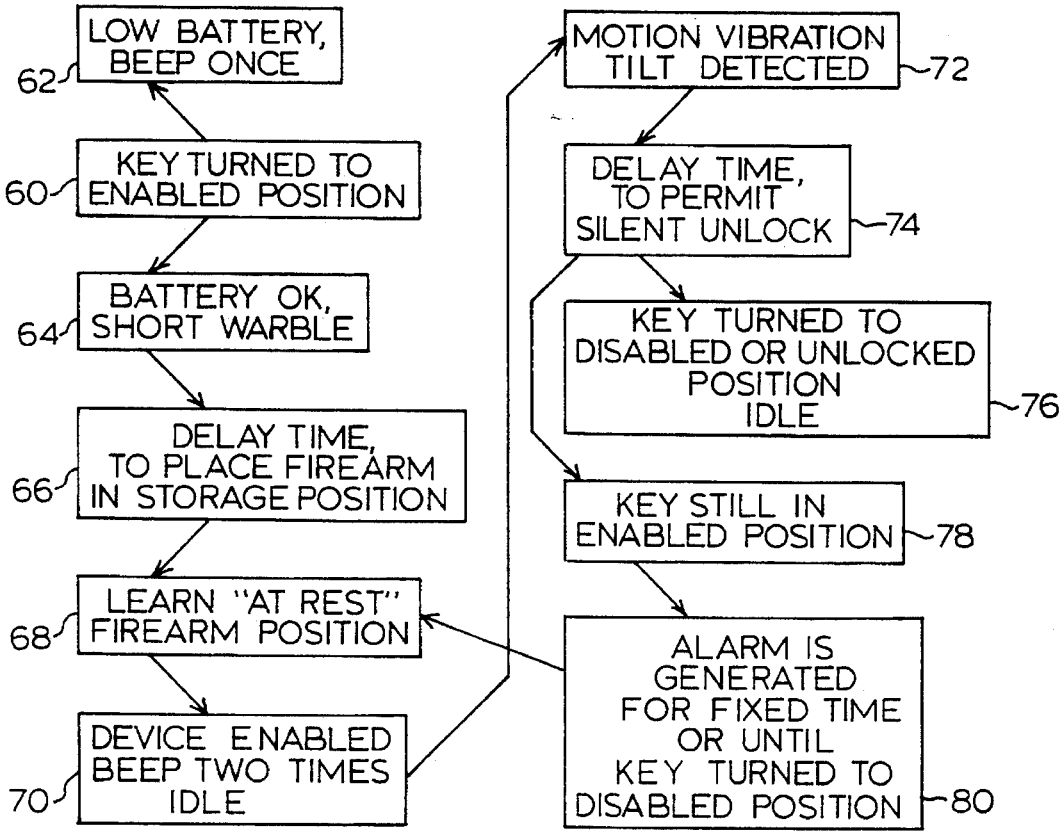
FIG. 5 is a flow diagram characterizing the preferred operation methodology of an embodiment of the present invention.

The operator, in order to activate the device 10, simply locks it and withdraws the key 40. As shown in FIG. 5, when the device 10 detects via the enabling switch 34 that the key 40 has been turned to the enabled position 60, the microcomputer 32 initiates the operational program as well as a variety of other functions such as checking the battery. If the battery voltage is too low, the microcomputer 32 will cause the alarm 38 to emit a distinctive sound, such as a single beep 62. If the battery voltage is adequate, a different distinctive sound, such as a short warble, is produced 64. The microcomputer 32 then delays for enough time for the firearm 12 to be placed in a storage position 66. The preferred delay time is 15 seconds. If the firearm 12 is still moving at the end of the delay interval the alarm 38 will sound, as will be Understood below. The microcomputer 32 then reads and learns the "at rest" position of the firearm 68 by testing the motion sensor 30. The microcomputer 32 then causes the alarm 38 to emit another distinctive sound, such as two short beeps, to inform the outside world that it has determined the position of the firearm 12 and is now armed 70. The microcomputer 32 then idles 70 while testing the motion sensor 30 for any motion, vibration or change in tilt that indicates that the firearm is being moved.

When the microcomputer 32 detects via the motion sensor 30 that motion, vibration or change in tilt is occurring 72, indicating that the firearm is being touched, the microcomputer 32 starts a fixed time delay to permit the device 10 to be unlocked or disabled 74 prior to the alarm being sounded. If the key 40 is turned to the disabled or unlocked position during this time delay, the alarm will not sound 76. In this manner, silent access to the firearm 12 is permitted as required by most private firearm owners. The preferred time delay is about 10 seconds, If the enabling switch 34 indicates that the key-actuator is still in the enabled position at the end of this time delay 78, an alarm 38 such as a piezoelectric siren is generated for a fixed period of time or until the key-actuated enabling switch is turned to the disabled position 80 to call attention to the movement of the firearm 12. The preferred duration of the alarm signal is about three minutes. The alarm will also announce the location of the weapon as well as the notice of its movement. The person holding the weapon cannot stop the alarm by holding it still or returning to its original position. Following completion of the alarm generation 80, the microcomputer 32 will automatically terminate the alarm generation signal and reset itself to await a further movement of the firearm 68.

Another embodiment of the firearm locking device and alarm further comprises a transmitter or a transponder 94 disposed within the electronics package 96 which may replace or work in conjunction with the alarm. The transmitter may be adapted to transmit to a receiver connected to a remote alarm or an existing alarm system such as a home or office security system. Remote status checking of the device is also possible in this embodiment of the present invention including checking of the battery, firearm movement, device enabling, etc.

An embodiment of the firearm locking device and alarm including a transponder allows a remote transmitter/receiver 94 to be used in conjunction with a directional antenna at a central location, so as to permit the directional tracking of the device via standard triangulation methodology or more simply point and follow methodology. Furthermore, the incorporation of the transponder permits the remote transmitter/receiver to determine whether the device is in range or whether the firearm has moved since the last status check as well as battery checking, firearm movement, device arming, etc.

A further embodiment of the firearm locking device and alarm, which is used in conjunction with a transmitter and transponder, includes a satellite geographic locator 95. By transmitting or responding with the geographic location of the firearm, immediate and rapid location of a rapidly moving firearm, such as one being carried by a person running, can be determined.

The present invention has many advantageous features including providing an effective means for locking and securing a firearm to prevent both its unauthorized use and announce its movement. The device is a convenient, durable, lightweight and user-friendly computer-based mechanism that installs across the trigger guard of most firearms. The present invention overcomes the disadvantages of the prior art by providing the combined firearm locking device and an alarm. The alarm will deter children from tampering with the weapon, and because it cannot be removed without the key, will deter thieves from stealing the firearm. Quick, silent access is available for purposes of self-protection.

Although the present invention has been described in considerable detail with reference to certain preferred versions thereof, other versions are possible. Therefore, the spirit and scope of the appended claims should not be limited to the description of the preferred versions contained herein.

What is claimed is:

1. A firearm locking device and alarm to be detachably mounted on a trigger guard of a firearm to prevent operation and deter movement of the firearm, comprising:

(a) a first section being configured to fit over the trigger guard of the firearm;

(b) a second section being configured to fit over the trigger guard of the firearm in laterally opposed relationship to the first section to form a firearm locking device and alarm assembly;

(c) means for lockably connecting the first section and the second section against opposite faces of the trigger guard extending transversely through the trigger guard and in proximity to the trigger so as to engage therebetween, substantially enclosing and preventing access to, the trigger and trigger guard of the firearm;

(d) motion sensing means operatively associated with the firearm locking device and alarm assembly for sensing movement of the firearm; and (e) an alarm means operatively associated with the firearm locking device and alarm assembly for providing an alert signal in response to the movement of the firearm.

2. The firearm locking device and alarm according to claim 1, further comprising a DC power source operatively associated with the firearm locking device and alarm assembly.

3. The firearm locking device and alarm according to claim 1, further comprising a microcomputer operatively associated with the firearm locking device and alarm assembly, the microcomputer adapted to receive an alarm actuating signal from the motion sensing means, whereby the microcomputer will emit an alarm generating signal.

4. The firearm locking device and alarm according to claim 1, further comprising an enabling switch operatively associative with the firearm locking device and alarm assembly so that when the lock is engaged a switch is also engaged arming the motion sensing means, and that when the lock is disengaged the switch is also disengaged disarming the motion sensing means.

5. The firearm locking device and alarm according to claim 1, wherein the first section further comprises:

(a) an internal DC power source;

(b) an internal motion sensing means for sensing movement of the firearm and for generating an alarm actuating signal in response to the movement;

(c) an internal microcomputer connected between the DC power source and the motion sensing means adapted to receive the alarm actuating signal from the motion sensing means, whereby the microcomputer will emit an alarm generating signal;

(d) an internal enabling switch connected to the microcomputer for activating the microcomputer upon lockable connection of the first section and the second section;

(e) an internal autotransformer connected to the microcomputer for amplifying the alarm generating signal of the microcomputer; and (f) an internal alarm means connected to the DC power source and the autotransformer for activation in response to the alarm activation signal to provide an alert signal.

6. The firearm locking device and alarm according to claim 5, further comprising programming means within the microcomputer for causing the microcomputer to block the alarm generating signal until after a predetermined period of time after activation of the internal enabling switch.

7. The firearm locking device and alarm according to claim 5, further comprising a program within the microcomputer which is activated by the motion sensing means causing the microcomputer to emit an alarm generating signal only after a predetermined period of time after activation.

8. The firearm locking device and alarm according to claim 5, further comprising programming means for causing the microcomputer to emit an alarm generating signal for a predetermined period of time and then causes the microcomputer to cease emitting an alarm generating signal.

9. The firearm locking device and alarm according to claim 5, further comprising programming means for causing the microcomputer to emit a signal causing the alarm means to emit an audible sound alter the device and alarm are initially armed.

10. The firearm locking device and alarm according to claim 5, wherein the motion sensing means is an omnidirectional mercury switch.

11. The firearm locking device and alarm according to claim 5, wherein the motion sensing means is a mass-loaded contact spring.

12. The firearm locking device and alarm according to claim 5, wherein the internal enabling switch comprises a key-actuated switch with a key opening extending through an exposed wall of the first section.

13. The firearm locking device and alarm according to claim 5, wherein the alarm means comprises an audible alarm means for providing an audible alarm signal.

14. The firearm locking device and alarm according to claim 13, wherein the audible alarm means is a piezoelectric device.

15. The firearm locking device and alarm according to claim 13, wherein the audible alarm means is a siren of about 100 decibels.

16. The firearm locking device and alarm according to claim 1, wherein the lockably connecting means comprises:

(a) a lock pin having a first end and an opposite second end and longitudinal axis, the first end connected to the second section and extending transversely of the plane of the second section, the lock pin having serrations extending along the longitudinal axis of the surface of one side of the lock pin;

(b) the first section having a lock pin hole guide for receiving the lock pin;

(c) a catch located within the first section having second serrations which are complimentary in shape to the first serrations for engaging the lock pin; and (d) means for releasably positioning the second serrations in or out of engagement with the first serrations whereby the first section and the second section may be adjustably connected against the opposite faces of the trigger guard of the firearm in connected spaced relation.

17. The firearm locking device and alarm according to claim 16, wherein the releasably positioning means comprises a key-actuated switch located within the first section with a key opening extending through an exposed wall of the first section such that when the key-actuated switch is in a first position the second serrations are engaged with the first serrations whereby the first section and second section are lockably connected, and in a second position the second serrations are moved out of position with the first serrations to allow the first section and second section to be moved together to engage the trigger and trigger guard, or moved apart to release the lock pin of the second section from its relationship disposed within the lock pin hole guide of the first section so that the firearm locking device and alarm can be removed from the firearm.

18. The firearm locking device and alarm according to claim 17, wherein the key-actuated switch is an enabling switch and in the first position the microcomputer is activated and in the second position the microcomputer is disabled.

19. The firearm locking device and alarm according to claim 17, wherein the key-actuated switch is a three-position enabling switch whereby in a first position the microcomputer is activated and the second serrations are engaged with the first serrations whereby the first section and second section are lockably connected, in a second position the microcomputer is disabled and the second serrations are engaged with the first serrations whereby the first section and second section are lockably connected, and in a third position the microcomputer is disabled and the second serrations are moved out of position with the first serrations to allow the first section and second section to be moved together to engage the trigger and trigger guard, or moved apart to release the lock pin of second section from its relationship disposed within the lock pin hole guide of the first section so that the firearm locking device and alarm can be removed from the firearm.

20. The firearm locking device and alarm according to claim 16, wherein the lockably connecting means further comprises a resilient means to bias the first serrations into engagement with the second serrations.

21. The firearm locking device and alarm according to claim 1, wherein the first section and the second section have opposed surfaces and wherein a resilient pad is provided on each of the opposed surfaces, the exposed face of each pad having a plurality of protuberances.

22. The firearm locking device and alarm according to claim 1, further comprising a transmitter located within the first section for transmission of the alarm generating signal to a remote receiving and alarm device and for remote status checking.

23. The firearm locking device and alarm according to claim 1, further comprising a transponder for the purpose of directional tracking and for remote status checking.

* * * * *